US009037012B2

(12) United States Patent
Kiyama

(10) Patent No.: US 9,037,012 B2
(45) Date of Patent: May 19, 2015

(54) IMAGE FORMING APPARATUS

(71) Applicant: CANON KABUSHIKI KAISHA, Tokyo (JP)

(72) Inventor: Kota Kiyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/183,983

(22) Filed: Feb. 19, 2014

(65) Prior Publication Data

US 2014/0233971 A1 Aug. 21, 2014

(30) Foreign Application Priority Data

Feb. 19, 2013 (JP) ..... 2013-029570

(51) Int. Cl.
*G03G 15/01* (2006.01)
*G03G 15/16* (2006.01)

(52) U.S. Cl.
CPC ..... *G03G 15/16* (2013.01)

(58) Field of Classification Search
USPC ..... 399/38–40, 46, 47, 49, 72, 301, 302, 399/308
See application file for complete search history.

(56) References Cited

U.S. PATENT DOCUMENTS

| | | | | |
|---|---|---|---|---|
| 7,509,082 | B2 * | 3/2009 | Goto | 399/301 |
| 8,494,387 | B2 * | 7/2013 | Kawamura | 399/66 |
| 8,583,025 | B2 * | 11/2013 | Fujii et al. | 399/394 |
| 8,594,543 | B2 * | 11/2013 | Krucinski et al. | 399/301 |
| 8,705,993 | B2 | 4/2014 | Mori et al. | |

FOREIGN PATENT DOCUMENTS

| | | | |
|---|---|---|---|
| JP | 64-006981 | A | 1/1989 |
| JP | 2009-134264 | A | 6/2009 |
| JP | 2012-103649 | A | 5/2012 |

* cited by examiner

*Primary Examiner* — Hoan Tran
(74) *Attorney, Agent, or Firm* — Fitzpatrick, Cella, Harper & Scinto

(57) ABSTRACT

A control portion controls a drive of rotation of an image carrier and registers a second index with a first index passing through a transfer position at real time at the time of image formation. Before starting the image formation, the toner image forming portion is controlled to adjust misalignment between the first index and the second index. Accordingly, the second index is formed at a position on the image carrier which is registered with the first index in advance, so that a large amount of control for compensating a large amount of phase misalignment is no longer necessary.

11 Claims, 13 Drawing Sheets

9
53
F

LOW POTENTIAL PORTION
HIGH POTENTIAL PORTION

POTENTIAL DISTRIBUTION

OUTPUT VOLTAGE

IMAGE FORMING APPARATUS

BACKGROUND OF THE INVENTION

1. Field of the Invention

This disclosure relates to an image forming apparatus configured to transfer a toner image on an image carrier by registering indices on a belt member and the image carrier.

2. Description of the Related Art

In the related art, a so-called tandem type image forming apparatus configured to overlap a second toner image formed on a second image carrier on a first toner image formed on a first image carrier and conveyed by a belt member, and transfer the overlapped toner images is widely used. In such an image forming apparatus, in order to avoid positional misalignment of overlap between the first toner image and the second toner image in a direction of conveyance, for example, JP-A-64-6981 describes a configuration in which registration marks formed out of an image area on a belt are detected by an imaging device, and the exposure start timing with respect to a photosensitive drum is adjusted in accordance with misalignment of the timing of detection.

In addition, JP-A-2009-134264 discloses a configuration in which a speed of rotation of a photosensitive drum on which an image is being formed (or a position of an intermediate transfer belt in the direction of rotation) is adjusted so as to register a second positional index magnetically recorded on the photosensitive drum with respect to a first positional index that is magnetically recorded on the intermediate transfer belt.

Furthermore, JP-A-2012-103649 discloses a configuration in which a speed of rotation of an image being formed is adjusted so as to register an electrostatic image index formed on an end of a second photosensitive drum with respect to an electrostatic image index transferred from a first photosensitive drum to an electrostatic image recording zone of an intermediate transfer belt.

Since the technology disclosed in JP-A-64-6981 is configured to adjust the exposure start timing, out-of-registration of color in short cycles caused by partial expansion or contraction of the belt being operated or speed variations is difficult to correct.

In contrast, the image forming apparatuses disclosed in JP-A-2009-134264 and JP-A-2012-103649 are configured to register the position of the second positional index on the image carrier with the position of the first positional index on the intermediate transfer belt by adjusting the speed of rotation of the photosensitive drum, so that the problem as described above rarely occurs. However, speed variations may occur in photosensitive drum when adjusting the speed of rotation of the photosensitive drum. When such speed variations are significant, turbulence of a scanning line pitch of an image may be generated and hence quality of an output image may be degraded.

SUMMARY OF THE INVENTION

According to an aspect of this disclosure, there is provided an image forming apparatus including an image carrier, a toner image forming portion configured to form a toner image on the image carrier, a belt member on which the toner image carried on the image carrier is transferred at a transfer position, a first index preparing portion configured to prepare a first index on the belt member before the toner image carried on the image carrier is transferred, the first index corresponding to a position on the belt member in a direction of movement of the belt member of the toner image to be transferred from the image carrier, a second index preparing portion configured to prepare a second index on the image carrier, the second index corresponding to a position on the image carrier in a direction of rotation of the image carrier of the toner image, a first index detecting portion configured to detect the first index, a second index detecting portion configured to detect the second index, and a control portion configured to control the toner image forming portion such that a position on the image carrier where the second index is to be formed is registered to the first index at the transfer position before starting formation of the second index by the second index preparing portion and to control a drive of the image carrier such that the second index is registered to the first index at the transfer position, after the formation of the second index by the second index preparing portion has started, on a basis of results of the detection of the first index detecting portion and the second index detecting portion.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
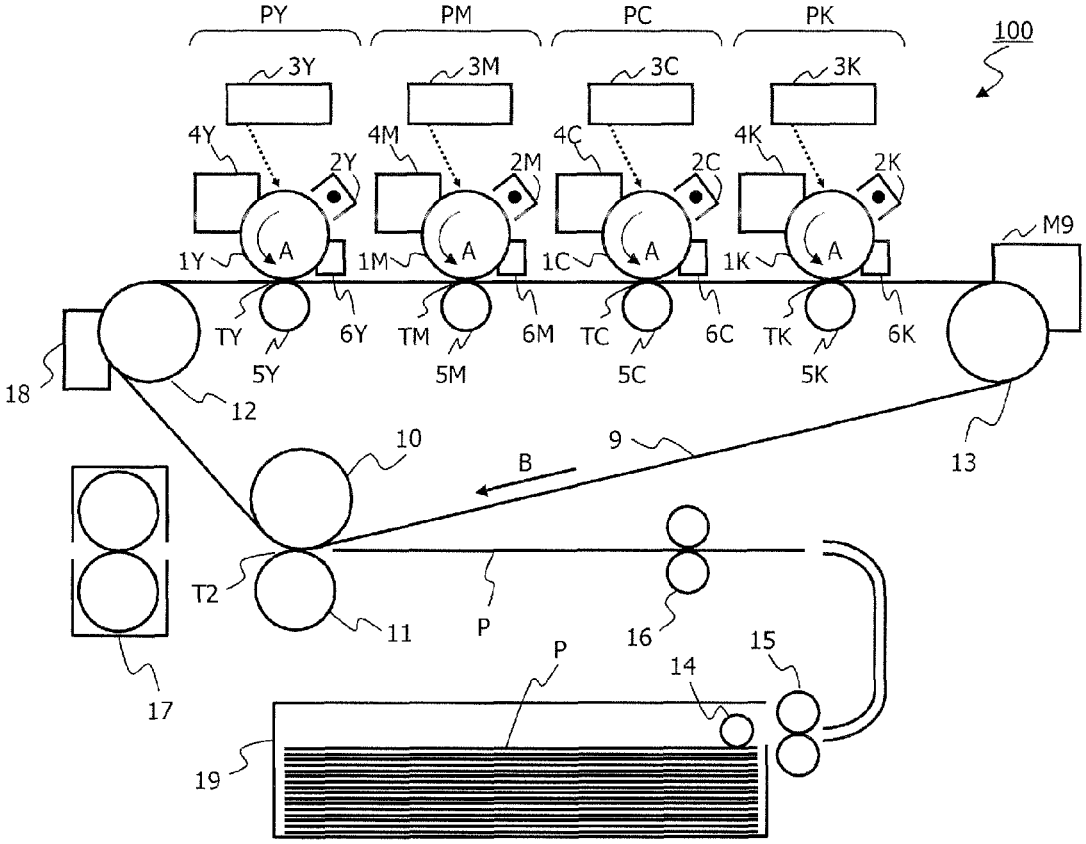
FIG. 1 is an explanatory drawing illustrating a configuration of an image forming apparatus.

Referring now to the drawings, detailed description of embodiments disclosed here will be given below. Members and numerical values or the like used in the description are examples only for the sake of understanding and are not intended to limit this disclosure.

First Embodiment

<Image Forming Apparatus>

Figure 2:
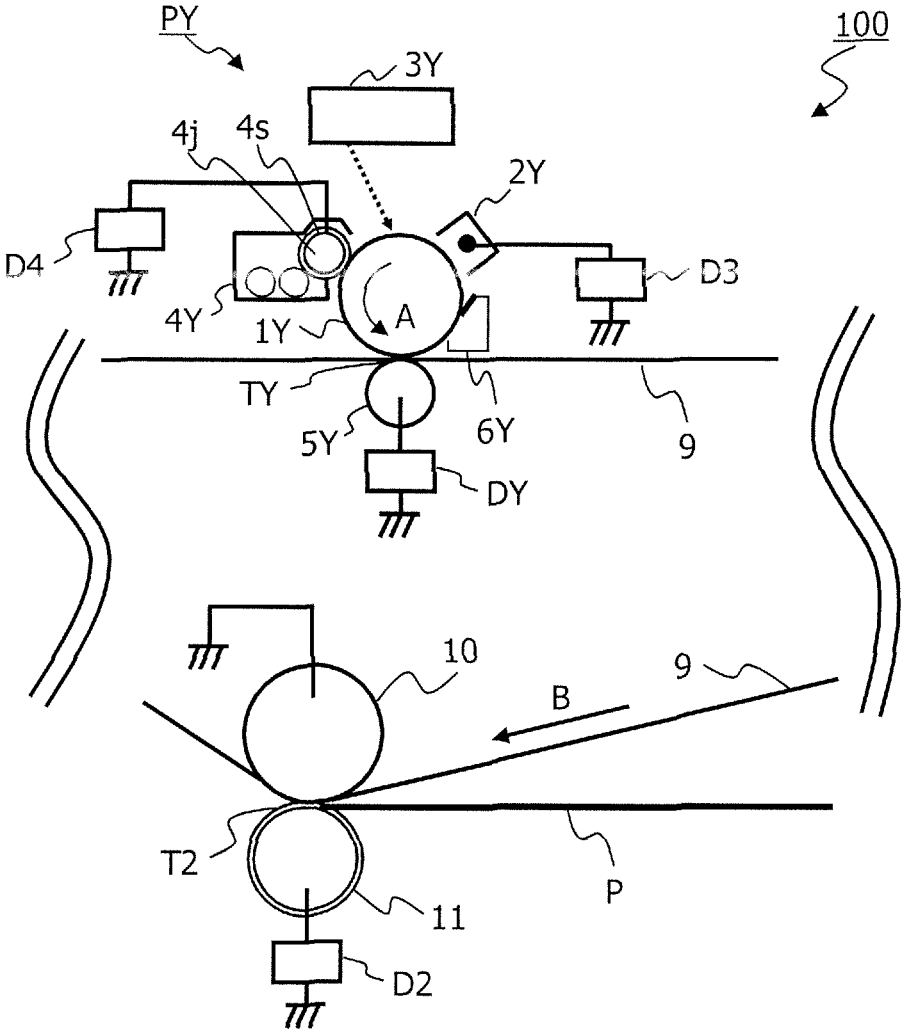
FIG. 2 is an explanatory drawing illustrating a configuration of an image forming portion.

FIG. 1 is an explanatory drawing illustrating a configuration of an image forming apparatus. FIG. 2 is an explanatory drawing illustrating a configuration of an image forming portion.

As illustrated in FIG. 1, an image forming apparatus 100 is a full-color laser beam printer in which image forming portions PY, PM, PC, and PK for yellow, magenta, cyan, and black are arranged along an intermediate transfer belt 9.

In the image forming portion PY, a yellow toner image is formed on a photosensitive drum 1Y and is transferred to the intermediate transfer belt 9. In the image forming portions PM, PC, and PK, a magenta toner image, a cyan toner image, and a black toner image are formed on photosensitive drums 1M, 1C, and 1K in the same manner and are transferred in sequence to the intermediate transfer belt 9.

The toner images transferred to the intermediate transfer belt 9 are conveyed to a secondary transfer position T2, and are secondarily transferred to recording material P. The recording material P is drawn out from a paper feed cassette 19 by a paper feed roller 14 while being separated into pieces by a separation unit 15, and is fed to registration rollers 16. The registration rollers 16 are configured to feed the recording material P to the secondary transfer position T2 with a leading edge thereof aligned with the toner image carried on the intermediate transfer belt 9.

The recording material P on which the toner images have been transferred is passed to a fixing unit 17, and subjected to a heat press, whereby a full color image is fixed to a surface thereof. A belt cleaning unit 18 collects residual toner remaining on the intermediate transfer belt 9 after the passage of the secondary transfer position T2.

The image forming portions PY, PM, PC, and PK have the same configuration except that the colors of toners used in developing units 4Y, 4M, 4C, and 4K are yellow, magenta, cyan, and black, which are different from each other. Therefore, in the following description, only the image forming portion PY for yellow will be described, and hence description of other image forming portions PM, PC, and PK are considered to have been given by replacing an alphabet Y at the end of reference sign with M, C, and K.

As illustrated in FIG. 2, the image forming portion PY includes a charging unit 2Y, an exposure unit 3Y, the developing unit 4Y, a primary transfer roller 5Y, and a drum cleaning unit 6Y arranged around the photosensitive drum 1Y.

The photosensitive drum 1Y is formed by applying an organic photoconductor layer (OPC) on an outer peripheral surface of an aluminum cylinder, and rotates in a direction indicated by an arrow A.

The charging unit 2Y charges a surface of the photosensitive drum 1Y at a uniform negative potential. The exposure unit 3Y is configured to scan and expose the surface of the charged photosensitive drum 1Y and form an electrostatic image corresponding to yellow image data on the photosensitive drum 1Y. The developing unit 4Y is configured to develop the electrostatic image on the photosensitive drum 1Y by using a two-component developer including toner and magnetic carrier mixed therewith and form a toner image. A power source D4 applies a development voltage on a developing sleeve 4*s* that rotates with the two-component developer carrying thereon.

The primary transfer roller 5Y presses an inner surface of the intermediate transfer belt 9 to form a primary transfer position TY between the photosensitive drum 1Y and the intermediate transfer belt 9. A power source DY applies a transfer voltage to the primary transfer position TY, and electrically transfer the toner image on the photosensitive drum 1Y to the intermediate transfer belt 9. The drum cleaning unit 6Y collects residual toner remaining on the photosensitive drum 1Y after the passage of the primary transfer position TY.

As illustrated in FIG. 1, the intermediate transfer belt 9 is supported so as to be extended around a drive roller 13, a tension roller 12, and a backup roller 10. The drive roller 13 is driven by a drive motor M9, and rotates the intermediate transfer belt 9 in a direction indicated by an arrow B. As illustrated in FIG. 2, a secondary transfer roller 11 is in press contact with the intermediate transfer belt 9 supported by the backup roller 10, and forms the secondary transfer position T2 between the secondary transfer roller 11 and the intermediate transfer belt 9. A power source D2 is configured to apply the transfer voltage to the secondary transfer position T2, and electrically transfer the toner image on the intermediate transfer belt 9 to a recording material conveyed through the secondary transfer position T2 together with the intermediate transfer belt 9 in a state of being placed thereon.

<Exposure Unit>

Figure 3:
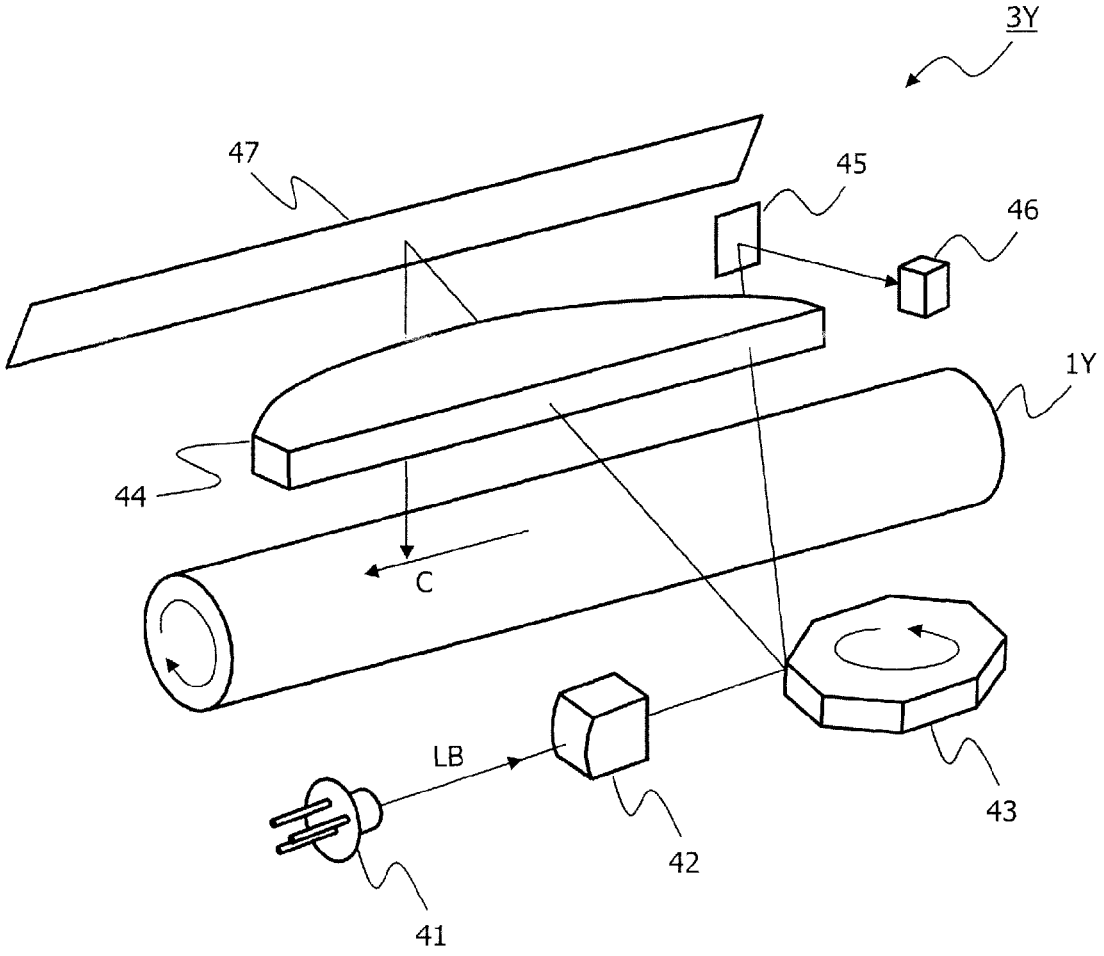
FIG. 3 is an explanatory drawing illustrating a configuration of an exposure unit.

FIG. 3 is an explanatory drawing illustrating a configuration of an exposure unit. As illustrated in FIG. 3, a semiconductor laser 41 of the exposure unit 3Y is configured to output a laser beam. LB that is ON-OFF modulated in accordance with scanning line image data which is a development of a yellow color separation image. The laser beam exposes the photosensitive drum 1Y by being scanned by a rotary polygonal mirror 43, and forms an electrostatic image composed of scanning lines corresponding to the scanning line image data on the photosensitive drum 1Y. The laser beam LB is modulated to have duty ratios in accordance with yellow concentrations of pixels to be formed on a recording material synchronously with the rotation of the rotary polygonal mirror 43.

The laser beam LB emitted from the semiconductor laser 41 reaches the rotary polygonal mirror 43 through a cylindrical lens 42. The rotary polygonal mirror 43 is directly driven and rotated by a motor, which is not illustrated, arranged at a position adjacent thereto.

The laser beam LB is deflected by the rotary polygonal mirror 43, passes through an fθ lens 44, and expose the surface of the photosensitive drum 1Y so as to scan to cause a beam spot to move at a constant speed in a direction indicated by an arrow C along the scanning lines on the photosensitive drum 1Y.

Part of the laser beam LB that has passed through the fθ lens 44 is reflected by a BD reflection mirror 45 provided at a position corresponding to an outside of an image area of the photosensitive drum 1Y and enters a BD sensor 46.

The BD sensor 46 is formed of a photodiode, and is configured to generate output signals used for generating the image wiring start timing in a main scanning direction of the exposure unit 3Y and detecting a state of rotation of the rotary polygonal mirror 43.

In the image area of the photosensitive drum 1Y, the laser beam LB scans and exposes in the main scanning direction along an axis of rotation of the photosensitive drum 1Y and forms an electrostatic image of scanning lines. The photosensitive drum 1Y rotates in a sub scanning direction, and arrays the scanning lines of the electrostatic image at regular intervals in the direction of rotation of the photosensitive drum 1Y.

<Registration Control at the time of Image Formation>

Figure 4:
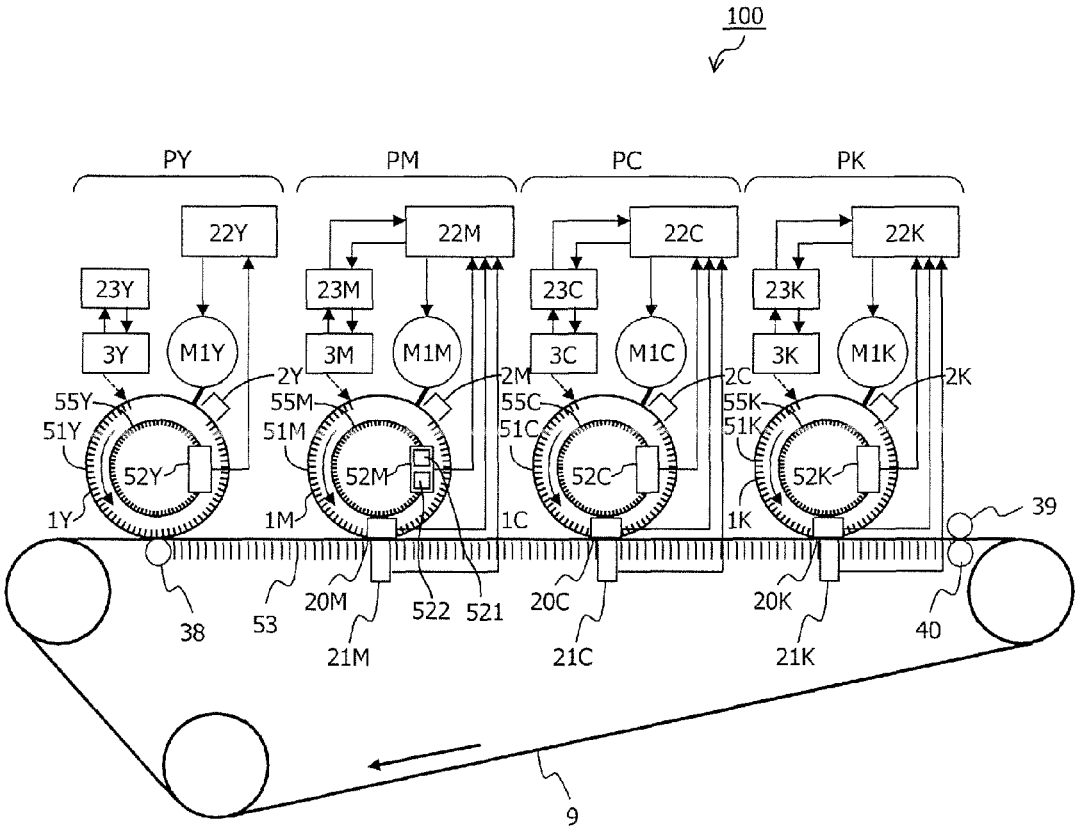
FIG. 4 is an explanatory drawing illustrating a registration control of toner images at the time of image formation.

FIG. 4 is an explanatory drawing illustrating registration control of toner images at the time of image formation. Transfer and control at the image forming portions PC and PK are practically the same as that at the image forming portion PM, so that only the image forming portions PY and PM will be described, and duplicated descriptions relating to the image forming portions PC and PK will be omitted below.

As illustrated in FIG. 1, the tandem-type image forming apparatus 100 is configured to form images on a large number of pieces of the recording material P per hour, and hence achieves high productivity. However, misalignment of images in the respective colors may occur due to errors or the like in image formation timing among a plurality of the image forming portions PY, PM, PC, and PK. The misalignment of the images in the respective colors makes color misalignment and color unevenness prominent at details of high-definition full-color image.

As illustrated in FIG. 4, electrostatic image indices 51Y, 51M, 51C, and 51K are recorded on the photosensitive drums 1Y, 1M, 1C, and 1K synchronously with writing of the scanning lines in the image forming apparatus 100. A yellow toner image formed in the image forming portion PY and the electrostatic image index 51Y are firstly transferred to the intermediate transfer belt 9. The electrostatic image index 51Y is transferred to the intermediate transfer belt 9, and forms an electrostatic image index 53. At the transfer position on the photosensitive drum 1Y, the electrostatic image index 51Y formed on the photosensitive drum 1Y is transferred to the intermediate transfer belt 9 to form the electrostatic image index 53.

In the image forming portion PM, a toner image and the electrostatic image index 51M are formed on the photosensitive drum 1M. The electrostatic image index 51M is detected by position detecting portions 20M, 20C, and 20K arranged at transfer positions. The electrostatic image index 53 on the intermediate transfer belt 9 is detected by a position detecting portion 21M arranged at the transfer position.

The image forming portion PM registers the position of the electrostatic image index 51M corresponding to the electrostatic image index 53 on the intermediate transfer belt 9 passing through the transfer position by using an output from the position detecting portion 20M and an output from the position detecting portion 21M. The image forming portion PM determines an advancement delay of electrostatic image index 51M on the photosensitive drum 1M with respect to the electrostatic image index 53 on the intermediate transfer belt 9, and transfers the toner image on the photosensitive drum 1M to the intermediate transfer belt 9 while changing the speed of rotation of the photosensitive drum 1M every second.

Drive motors M1Y and M1M drive the photosensitive drums 1Y and 1M to rotate at variable rotational speeds. Encoder scales 55Y and 55M are fixedly provided on shafts of the photosensitive drums 1Y and 1M. Rotation angle detecting portions 52Y and 52M using encoder sensors read the encoder scales 55Y and 55M and detect the rotation angles of the photosensitive drums 1Y and 1M, respectively.

A drive control portion 22Y controls drive of the drive motor M1Y on the basis of the rotation angle detected by the rotation angle detecting portion 52Y at the time of image formation, and rotates the photosensitive drum 1Y at a constant rotational angle. The exposure unit 3Y forms the electrostatic image index 51Y on the photosensitive drum 1Y. The electrostatic image index 51Y is transferred to the intermediate transfer belt 9 by an electrostatic image transfer roller 38, and forms the electrostatic image index 53.

A drive control portion 22M controls drive of the drive motor M1M so as to register the electrostatic image index 51M of the photosensitive drum 1M with the electrostatic image index on the intermediate transfer belt 9, and rotates the photosensitive drum 1M at variable rotation angles during the image formation. The exposure unit 3M forms the electrostatic image index 51M in an electrostatic image index area on the photosensitive drum 1M.

The electrostatic image index 51M is detected by the position detecting portion 20M arranged at the transfer position on the image forming portion PM. The position detecting portion 20M has the same configuration as the position detecting portion 21M that detects the electrostatic image index 53 of the intermediate transfer belt 9.

<Electrostatic Image Index Area>

Figure 5:
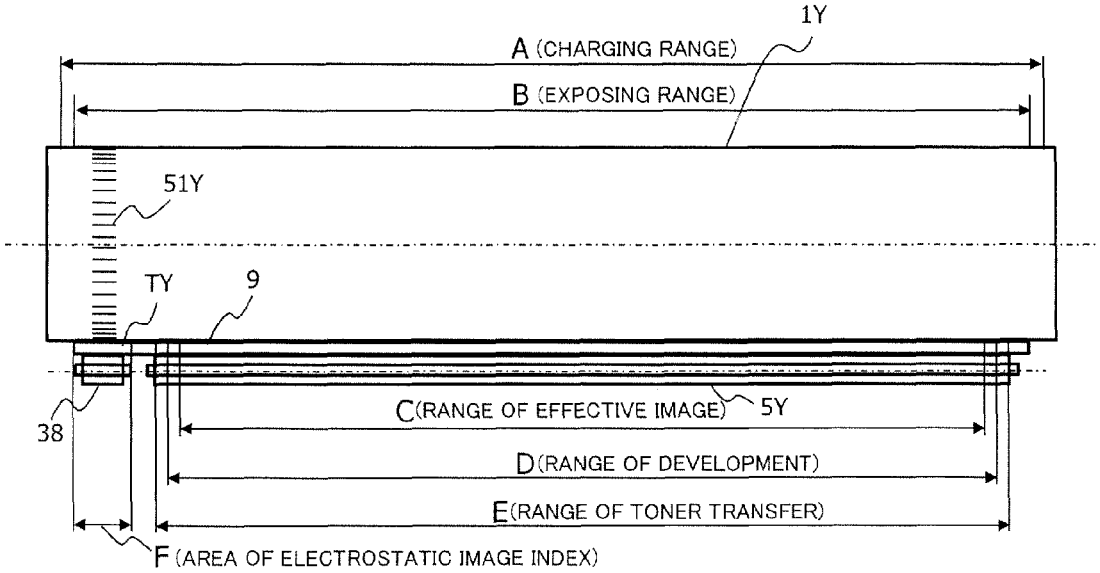
FIG. 5 is an explanatory drawing illustrating an arrangement of an electrostatic image index.

FIG. 5 is an explanatory drawing illustrating an arrangement of an electrostatic image index. As illustrated in FIG. 5, the photosensitive drum 1M is provided with an electrostatic index area F outside of a toner transfer range E. The electrostatic index area F is provided outside an effective image range C.

On the photosensitive drum 1Y, an electrostatic image in accordance with image data is drawn in the effective image range C by the exposure unit 3Y, and the electrostatic image index 51Y is written in the electrostatic index area F. Since the electrostatic index area F is provided outside a development range D, an electrostatic image index 51 is not developed on the toner image.

The electrostatic image index 51Y corresponds to end portions of the scanning lines formed on the photosensitive drum 1Y by the exposure unit 3Y. The electrostatic image index 51Y is an index pattern repeating 4 lines/4 spaces by using scanning lines of, for example, a resolution of 600 dpi. A pitch in the sub scanning direction of the electrostatic image index 51 is approximately 0.339 mm.

The electrostatic image index 51 on the photosensitive drum 1Y is transferred to the intermediate transfer belt 9 by the electrostatic image transfer roller 38 at the transfer position TY where the photosensitive drum 1Y and the intermediate transfer belt 9 come into contact with each other. A voltage, being different from that of the primary transfer roller 5Y, is applied to the electrostatic image transfer roller 38, and a charge pattern that forms the electrostatic image index 51Y is transferred to the intermediate transfer belt 9 under optimum transfer conditions different from transfer conditions of toner images.

The electrostatic index area F is different from other areas of the intermediate transfer belt 9, and is formed of a material having a high resistance having a volume resistivity of $10^{14}$ [Ω·c] or more. Therefore, a charge transferred once to the electrostatic index area F is held without being moved until being erased by an electrostatic image erasing roller 39 as illustrated in FIG. 4, and functions as the electrostatic image index 53. The electrostatic image index 53 is detected by position detecting portions 21M, 21C, and 21K which employ potential sensors capable of detecting a change of potential, then is transferred to a nip portion between the electrostatic image erasing roller 39 and an electrostatic image erasing opposed roller 40, and then is erased. A vibration voltage generated by superimposing a DC voltage with an AC voltage is applied on the electrostatic image erasing roller 39. The electrostatic image erasing opposed roller 40 is connected to a grounding potential. The vibration voltage applied to the electrostatic image erasing roller 39 smoothen a potential difference on the intermediate transfer belt 9, and erases the electrostatic image index 53.

<Electrostatic Image Index and Potential Sensor>

Figure 6A:
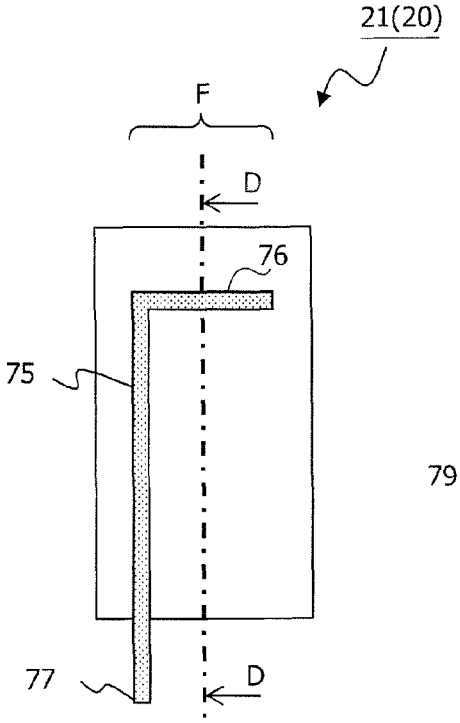
FIG. 6A is an explanatory drawing illustrating a configuration of a potential sensor.
Figure 6B:
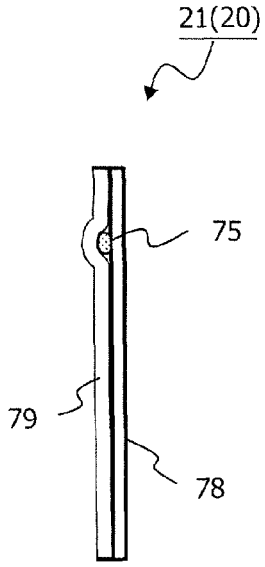
FIG. 6B is a cross-sectional view taken along a line D-D in FIG. 6A.
Figures 7A, 7B, 7C:
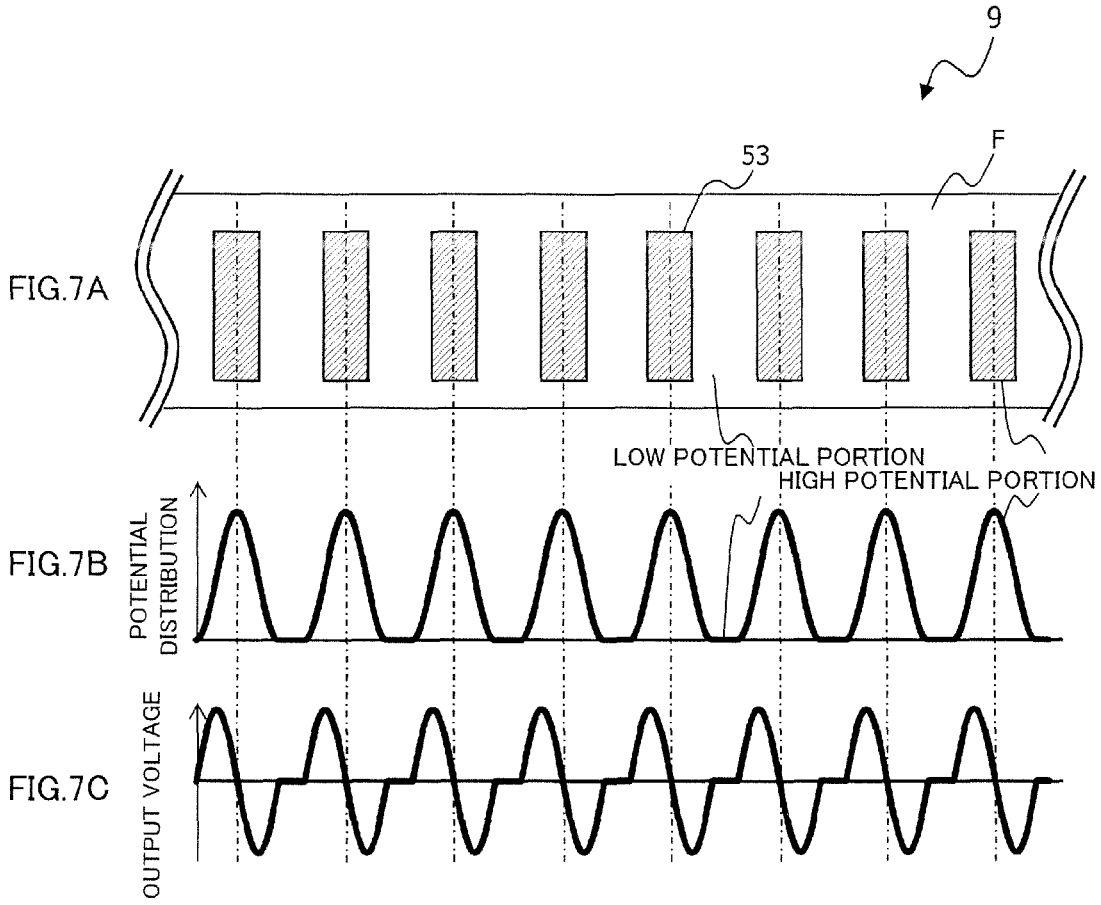
FIG. 7A is a drawing illustrating the electrostatic image index formed in an electrostatic image index area on an intermediate transfer belt.
FIG. 7B is a graph showing an actual potential distribution of the electrostatic image index.
FIG. 7C is a graph showing a voltage signal having an analogue waveform obtained by differentiating the potential distribution in FIG. 7B.

FIGS. 6A and 6B are explanatory drawings illustrating a configuration of the potential sensor. FIGS. 7A, 7B, and 7C are explanatory drawings illustrating electrostatic image indices and a detection signal of the potential sensor. FIG. 6B is a cross section D-D taken along a chain line in FIG. 6A.

Figure 6C:
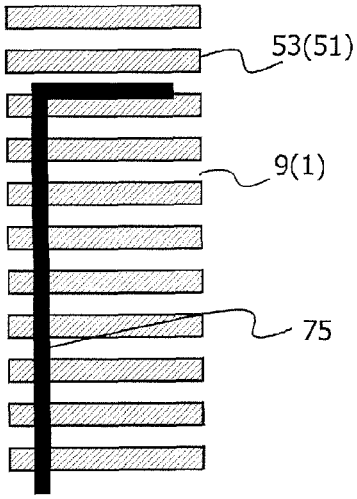
FIG. 6C is a drawing illustrating a positional relationship between a detecting portion and the electrostatic image index.

As illustrated in FIG. 6A, the position detecting portion 21 in which the potential sensor is used is formed by bending a conductor 75 formed of a metallic wire into an L-shape to form a detecting portion 76 at a distal end side thereof. As illustrated in FIG. 6B, the position detecting portion 21 includes the conductor 75 sandwiched between a base film 78 and a protective film 79 both formed of polyimide film. The position detecting portion 21 is arranged with the base film 78 side of the conductor 75 in contact with the electrostatic index area F of the intermediate transfer belt 9 as illustrated in FIG. 6A. As illustrated in FIG. 6C, the position detecting portion 21 is registered with respect to the intermediate transfer belt 9 so that the detecting portion 76 and the electrostatic image index 53 extend in parallel to each other and fixed at a root portion thereof. The position detecting portion 21 is a differential-type potential sensor configured to output a detection signal having a differential waveform of a potential distribution from an output unit 77 in response to approach/separation of a charge of the electrostatic image index 53.

As illustrated in FIG. 7A, the electrostatic image index 53 formed in the electrostatic index area F of the intermediate transfer belt 9 includes high-potential portions and low-potential portions that appear alternately. The high-potential portions correspond to areas exposed on the photosensitive drum 1Y. As illustrated in FIG. 7B, an actual potential distribution of the electrostatic image index 53 is not appeared in a rectangular wave because the amount of exposure by the laser beam has a distribution and is reduced in the peripheral area, but is appeared in a potential distribution similar to the Sin curve. When the position detecting portion 21 passes through the area of the potential distribution that is similar to the Sin curve, an induced current is generated in the detecting portion 76, and a voltage signal is output from the output unit 77.

As illustrated in FIG. 7C, an output signal from the position detecting portion 21 is a voltage signal having an analogue waveform obtained by differentiating the potential distribution in FIG. 7B. A point of a peak (inclination is zero) of the potential distribution illustrated in FIG. 7B is a center of the electrostatic image index, and times when the output voltage being decreased reaches zero in FIG. 7C are specified as times when the electrostatic image index 53 is detected.

<Vibration at the Time of Starting Registration>

As illustrated in FIG. 4, the image forming portion PM changes the rotation angle of the photosensitive drum 1M so that the electrostatic image index 51M of the photosensitive drum 1M is registered with the electrostatic image index 53 of the intermediate transfer belt 9 during the image formation. Therefore, the speed of rotation of the photosensitive drum 1M is controlled at a small amount of control so as to compensate minute positional misalignments occurring every second.

However, when the image formation is started, large amount of positional misalignment which corresponds to ½ pitch of the electrostatic image index 51M may occur between a leading mark of the electrostatic image index 53 of the intermediate transfer belt 9 and a leading mark of electrostatic image index 51M of the photosensitive drum 1M when reaching the transfer position. When an attempt is made to compensate such large amount of positional misalignment, the speed of rotation of the photosensitive drum 1M is controlled by large amount of control, so that large speed variations of the photosensitive drum 1M may occur. The speed variations of the photosensitive drum 1M may cause unevenness of the intervals of the scanning lines that the exposure unit 3M forms, and deteriorate the image quality.

Accordingly, in the following example, the exposure unit 3M is controlled to shift the position where the electrostatic image index 51M is to be formed in a state in which the first positional misalignment between the intermediate transfer belt 9 and the photosensitive drum 1M is maintained. Accordingly, the first mark of the electrostatic image index 51M with respect to the electrostatic image index 53 is registered at the transfer position even though the speed of the photosensitive drum 1M is not adjusted.

Figure 8:
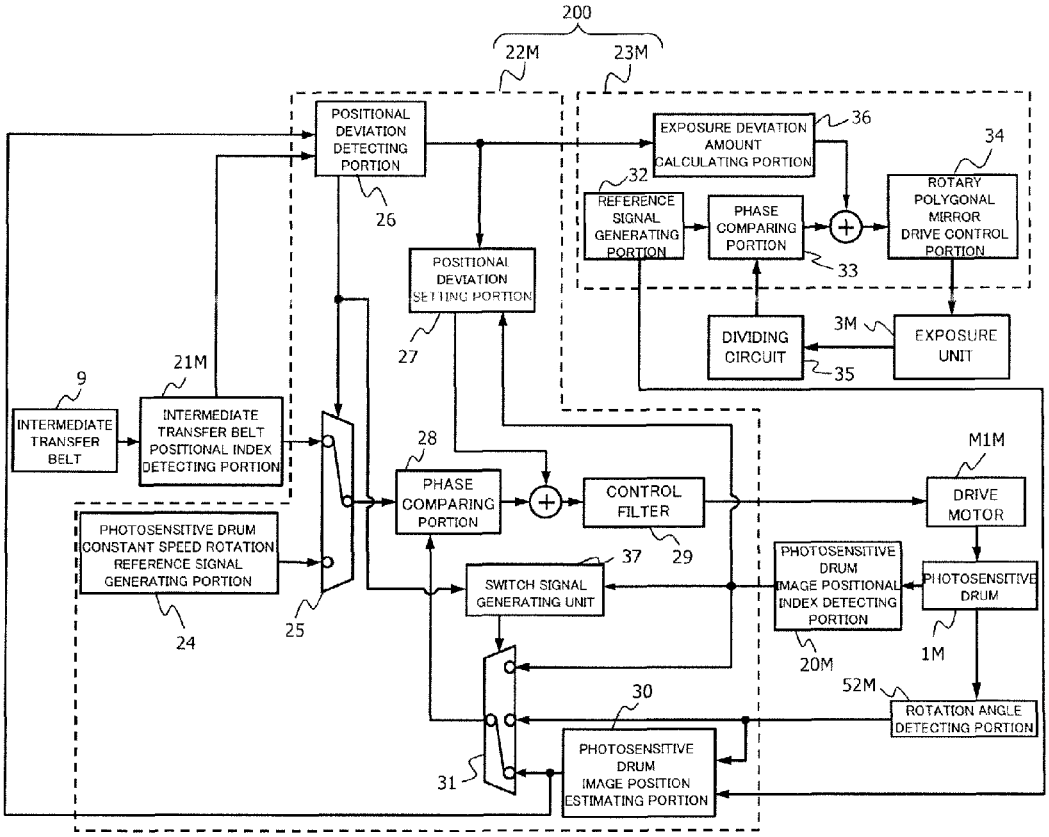
FIG. 8 is a control block diagram of a first embodiment.
Figure 9:
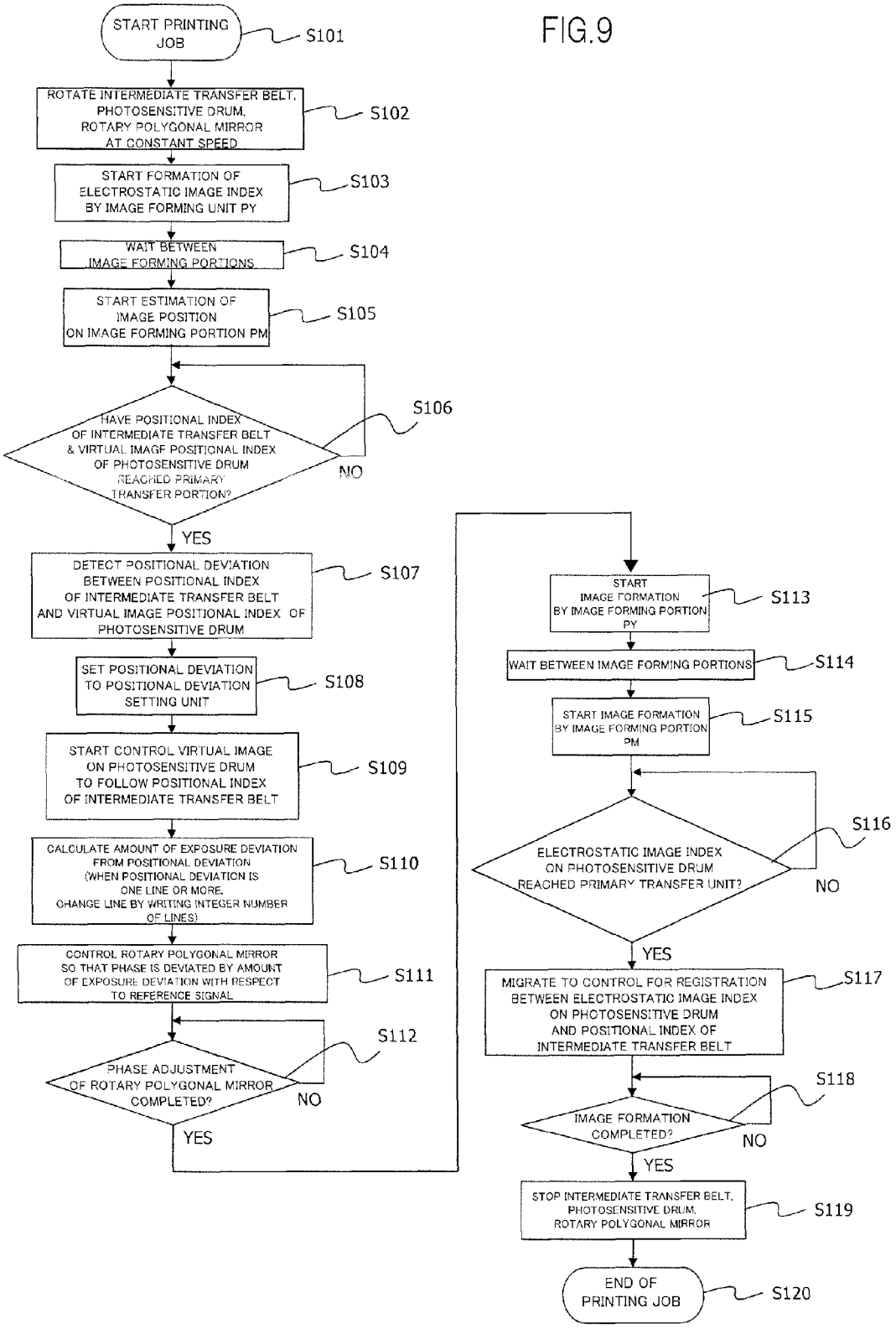
FIG. 9 is a flowchart of control of the first embodiment.
Figure 10:
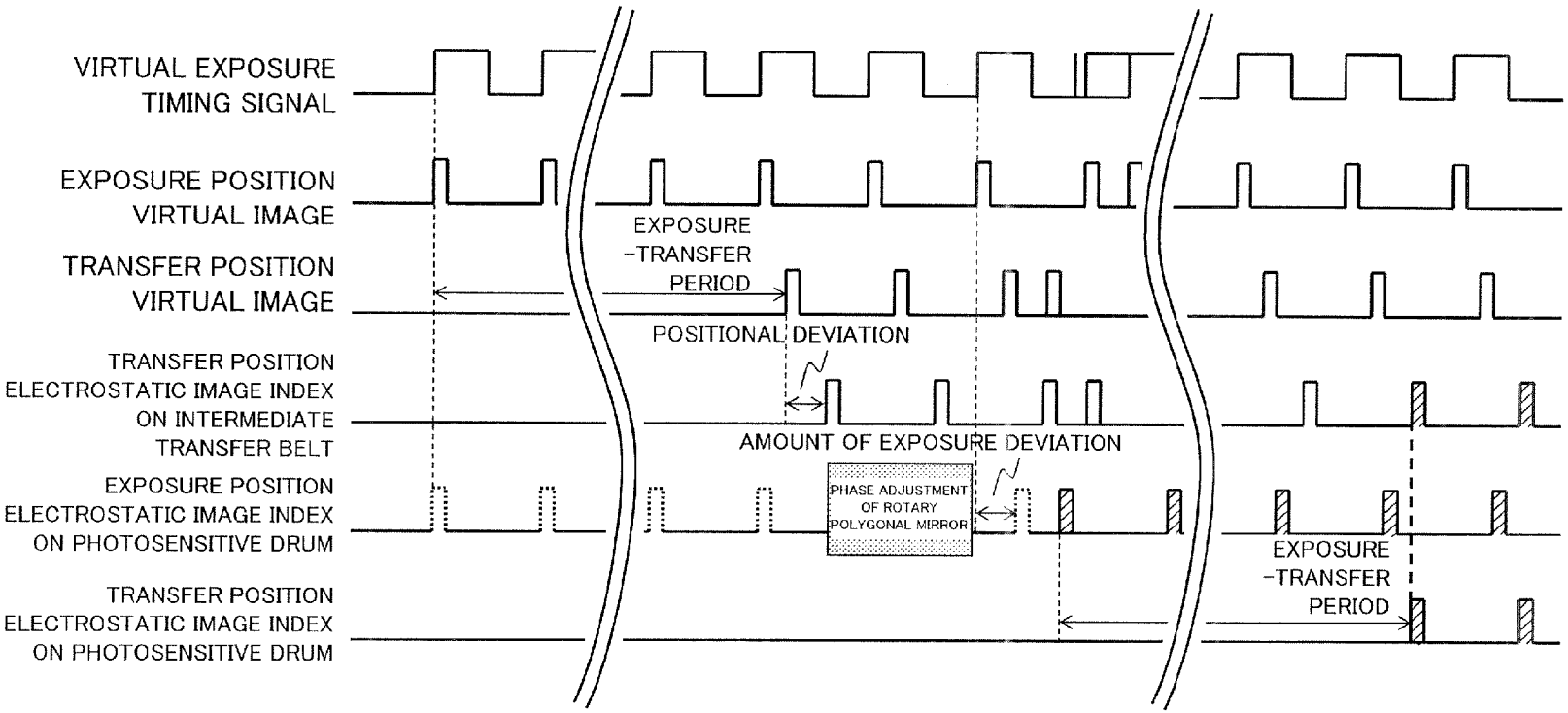
FIG. 10 is a time chart of the control of the first embodiment.
Figure 11:
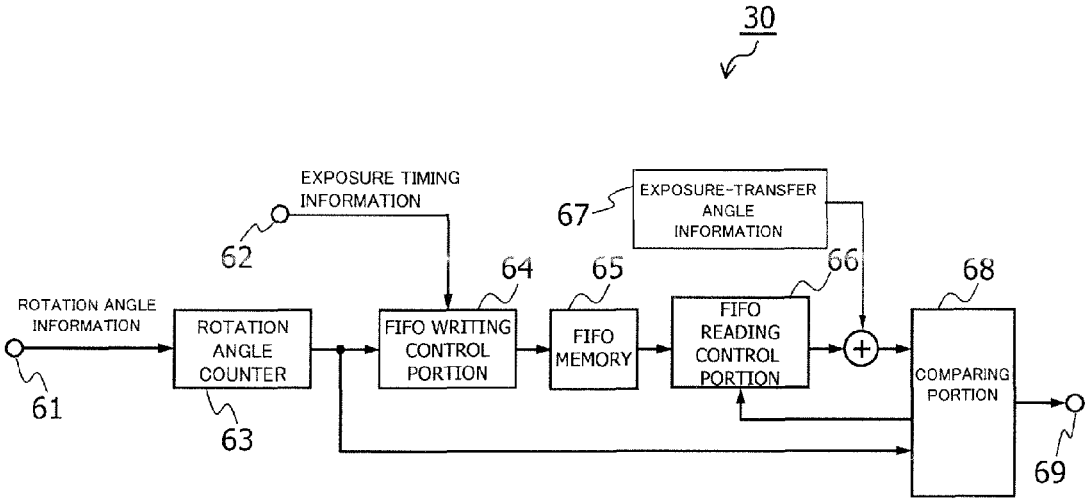
FIG. 11 is an explanatory drawing illustrating a configuration of a photosensitive drum image position estimating portion.

FIG. 8 is a control block diagram of a first embodiment. FIG. 9 is a flowchart of control of the first embodiment. FIG. 10 is a time chart of the control of the first embodiment. FIG. 11 is an explanatory drawing illustrating a configuration of a photosensitive drum image position estimating portion.

As illustrated in FIG. 4, in the first embodiment, the image forming portion PM, which is an example of a toner image forming portion, forms a toner image on the photosensitive drum 1M, which is an example of an image carrier. The toner image carried on the photosensitive drum 1M is transferred to the intermediate transfer belt 9, which is an example of a belt member at the transfer position TM.

The image forming portion PY, which is an example of a first index preparing portion, prepares the electrostatic image index 53, which is an example of a first index, on the intermediate transfer belt 9 before the toner image is transferred. The image forming portion PY forms the electrostatic image index 53 on the intermediate transfer belt 9 synchronously with the transfer of the yellow toner image to the intermediate transfer belt 9 before the toner image carried on the photosensitive drum 1M is transferred. The exposure unit 3Y, which is an example of an upstream side exposure unit, forms the electrostatic image index 51Y on the photosensitive drum 1Y in association with formation of the electrostatic image of the yellow toner image on the photosensitive drum 1Y, which is an example of an upstream side image carrier. The electrostatic image transfer roller 38, which is an example of an electrostatic image transfer portion, transfers the electrostatic image index 51Y formed on the photosensitive drum 1Y to the intermediate transfer belt 9 in association with the transfer of the yellow toner image to form the electrostatic image index 53.

The exposure unit 3M, which is an example of a second index preparing portion, prepares the electrostatic image index 51M, which is an example of a second index corresponding to respective positions in the direction of rotation of the toner image, on the photosensitive drum 1 in association with formation of the toner image by the image forming portion PM. The exposure unit 3M forms the electrostatic image index 51M on the photosensitive drum 1M synchronously with formation of the toner image on the photosensitive drum 1M. The exposure unit 3M forms the electrostatic image index 51M on the photosensitive drum 1M in association with formation of an electrostatic image of the toner image.

The encoder scale 55M, which is an example of a third index, is attached to the photosensitive drum 1M and is rotated integrally with the photosensitive drum 1M. The rotation angle detecting portion 52M detects the encoder scale 55M, and outputs a pulse signal which can specify time when a position on the photosensitive drum 1M where the electrostatic image index 51M is to be formed reaches the transfer position TM. In the first embodiment, the rotation angle detecting portion 52M includes a sensor unit (third index detecting portion) 521 configured to detect the encoder scale 55M, and a pulse generating portion 522 configured to process a signal from the sensor unit 521 and output the above-described pulse signal formed integrally therewith. However, for example, the pulse generating portion 522 may be provided on the drive control portion 22M.

The position detecting portion 21M, which is an example of a first index detecting portion, detects the electrostatic image index 53 at a position proximity of the transfer position TM. The position detecting portion 20M, which is an example of a second index detecting portion, detects the electrostatic image index 51M at a position proximity of the transfer position TM.

The drive control portion 22M after the start of formation of the electrostatic image index 51M by the exposure unit 3M, which is an example of a first control portion, controls the speed of rotation of the photosensitive drum 1M every second to register the electrostatic image index 51M with the electrostatic image index 53 passing through the transfer position TM at real time.

An exposure control portion 23M before the start of formation of the electrostatic image index 51M by the exposure unit 3M, which is an example of a second control portion, controls an exposure timing of the exposure unit 3M of the image forming portion PM. The exposure control portion 23M adjusts a moment of formation of the electrostatic image index 51Y by the exposure unit 3M so as to compensate the positional misalignment between the electrostatic image index 53 and the electrostatic image index 51M. The exposure control portion 23M adjusts a moment of formation of the electrostatic image index 51M by the exposure unit 3M corresponding to a phase misalignment between a pulse signal that the position detecting portion 21M outputs upon detection of the electrostatic image index 53 and a pulse signal that the rotation angle detecting portion 52M outputs. In the first embodiment, the drive control portion 22M and the exposure control portion 23M constitute a control portion 200 that exhibits various functions, which will be described later, by a program memorized in a general-purpose CPU and a memory such as a RAM or a ROM formed integrally with each other. However, the drive control portion 22M and the exposure control portion 23M may be formed separately, and the respective functions may be configured by a specific control circuit instead of the general-purpose CPU or by a combination of the general-purpose CPU and the specific control circuit as a matter of course.

Accordingly, the position on the photosensitive drum 1M where the electrostatic image index 51M is to be formed is registered with the corresponding electrostatic image index 53 at the transfer position TM. At this time, the drive control portion 22M controls the speed of rotation of the photosensitive drum 1M in accordance at least with the result of detection of the position detecting portion 21M to maintain the positional misalignment between the electrostatic image index 53 and the electrostatic image index 51M at the transfer position TM due to the variation in speed of the intermediate transfer belt 9 constant.

<Constant Speed of Rotation>

Referring to FIG. 8, when a command to start an image forming job is issued (S101) as illustrated in FIG. 9, the drive control portion 22M and the exposure control portion 23M start rotations of the intermediate transfer belt 9, the photosensitive drum 1M, and the rotary polygonal mirror (43: FIG. 4) of the exposure unit 3M (S102).

At this time, a lower terminal of a switch 25 is connected and a central terminal of a switch 31 is connected, and hence the photosensitive drum 1M is controlled to a constant speed on the basis of a clock signal of a photosensitive drum constant speed rotation reference signal generating portion 24.

The photosensitive drum constant speed rotation reference signal generating portion 24 outputs a clock signal of a constant cycle corresponding to a resolution of the rotation angle detecting portion 52M (encoder sensor). A phase comparing portion 28 calculates a phase difference between the clock signal and the output signal from the rotation angle detecting portion 52M.

At this time point, since an output from a positional deviation setting portion 27 is zero, a control filter 29 outputs a motor drive signal so that the phase difference calculated by the phase comparing portion 28 is zero. In this manner, the photosensitive drum 1M is driven to rotate at a constant speed.

A reference signal generating portion 32 of the exposure control portion 23M generates a clock signal (exposure reference signal) corresponding to the cycle of rotation of the rotary polygonal mirror. The reference signal generating portion 32 generates a clock signal (exposure reference signal) of a cycle obtained by multiplying the target cycle of exposure scanning by the number of surfaces of the rotary polygonal mirror (for example, multiplied by 8 in the case of an octahedron).

A phase comparing portion 33 obtains a phase difference between the exposure reference signal and a signal obtained by dividing the output signal (BD signal) from the BD sensor (46: FIG. 3) provided on the exposure unit 3M by the number of surfaces, (for example, divided by 8 in the case of the octahedron). The reason why the BD signal is divided by the number of surfaces because an influence of variations of the BD signal due to manufacture errors of the rotary polygonal mirror is alleviated and the speed of rotation of the rotary polygonal mirror is accurately detected.

A rotary polygonal mirror drive control portion 34 outputs a motor drive signal so that the phase difference between two input signals calculated by the phase comparing portion 33 becomes zero. In this manner, the rotary polygonal mirror (43: FIG. 3) of the exposure unit 3M is driven to rotate at a constant speed.

At this time point, an output from an exposure deviation amount calculating portion 36 is zero. The rotary polygonal mirror is driven to rotate at a constant speed synchronously with the exposure reference signal as described thus far.

<Control Before Transfer>

When a state in which the intermediate transfer belt 9, the photosensitive drums 1Y and 1M, and the rotary polygonal mirrors of the exposure units 3Y and 3M rotate at a constant speed is achieved, formation of the electrostatic image index is started in the image forming portion PY (S103). The electrostatic image index 51Y formed on the photosensitive drum 1Y is transferred to the intermediate transfer belt 9 as described above, and the electrostatic image index 53 which functions as a positional index of the intermediate transfer belt is obtained.

When an image conveyance time between the image forming portions PY and PM is elapsed after the formation of the electrostatic image index 51Y in the image forming portion PY has started (S104), a positional deviation detecting portion 26 connects the switch 25 to an upper terminal thereof and the switch 31 to a lower terminal thereof via a switch signal generating portion 37. Accordingly, the drive control portion 22M starts estimation of the position of the image in the image forming portion PM (S105).

At this time, the reference signal generating portion 32 of the exposure control portion 23M outputs a clock signal (virtual exposure timing signal) having a cycle corresponding to the pitch of the electrostatic image index formed in the image forming portion PY synchronously with the exposure reference signal. Therefore, the rotary polygonal mirror (43: FIG. 4) of the exposure unit 3M is driven to rotate synchronously with the exposure reference signal synchronized with the virtual exposure timing signal.

A photosensitive drum image position estimating portion 30 estimates a virtual position of the image on the photosensitive drum 1M, which is an example of "on the image carrier". The photosensitive drum image position estimating portion 30 outputs a pulse signal indicating a timing at which the virtual electrostatic image index (51M) on the photosensitive drum 1M reaches the transfer position by using the virtual exposure timing signal and the rotation angle information of the photosensitive drum 1M. The phase comparing portion 28 uses the pulse signal as a detection signal of the virtual electrostatic image index (corresponding to 51M) of the photosensitive drum 1M.

The positional deviation detecting portion 26 waits that the first mark of the electrostatic image index 53 formed actually on the intermediate transfer belt 9 and the first mark of the virtual image positional index of the photosensitive drum 1M reach the transfer position of the image forming portion PM (S106).

The positional deviation detecting portion 26 detect a time difference obtained by subtracting time when the first mark of the electrostatic image index 53 reaches the transfer position of the image forming portion PM from time when the first mark of the virtual image positional index reaches the transfer position of the image forming portion PM as a positional deviation (S107).

The positional deviation detecting portion 26 sets the detected positional deviation to the positional deviation setting portion 27 and the exposure deviation amount calculating portion 36 (S108).

The positional deviation setting portion 27 starts control to cause a virtual image position on the photosensitive drum 1M to follow the electrostatic image index 53 of the intermediate transfer belt 9 (S109). The positional deviation setting portion 27 adds the input positional deviation to a control loop of the photosensitive drum 1M as an amount of deviation, and hence the rotation of the photosensitive drum 1M is controlled so that the amount of misalignment between the first mark of the electrostatic image index 53 and the first mark of the virtual image positional index of the photosensitive drum 1M is maintained.

The exposure deviation amount calculating portion 36 calculates the exposure deviation amount on the basis of the input positional deviation (S110). In other words, when the input positional deviation corresponds to one or more lines in the sub scanning direction, an image writing timing of the image forming portion PM is changed by an amount corresponding to an integer number of lines. Specifically, a delay time from the timing of the start of the image formation in the image forming portion PY until the timing of the start of image formation in the image forming portion PM when performing the image formation later is changed.

When the exposure scanning cycle (the cycle corresponding to one line in the sub scanning direction) is 141 μsec, and the input positional deviation is 170 μsec, for example, the delay time is reduced by an amount corresponding to one line=141 μsec by using the following expression, $$170 \div 141 = 1 \ldots 29 \text{(reminder)}$$

The exposure deviation amount calculating portion 36 outputs a value (−29 μsec) obtained by subtracting the above-described delay time change value (141 μsec) from the value of the positional deviation (170 μsec) with an inverted sign as an amount of exposure deviation. However, when the input positional deviation is less than one line in the sub scanning direction, the change of the delay time is not performed, and the value of the positional deviation with inverted sign is output as an amount of exposure deviation.

The exposure deviation amount calculating portion 36 adds the amount of exposure deviation to the control loop of the rotary polygonal mirror 43 as an amount of deviation, and hence the rotation of the rotary polygonal mirror 43 is controlled so that a state in which the phase is deviated by the amount of exposure deviation with respect to the exposure reference signal is maintained (S111). The rotary polygonal mirror drive control portion 34 causes the rotary polygonal mirror 43 to perform deceleration/acceleration (acceleration/deceleration), and performs phase adjustment of the rotation of the rotary polygonal mirror 43 so that the phase difference between the electrostatic image index 53 of the intermediate transfer belt 9 and the electrostatic image index 51M of the photosensitive drum 1M becomes zero at the transfer position.

<Transfer Control>

The image forming portion PY waits until the phase adjustment of the rotary polygonal mirror 43 is completed (Yes in S112), and starts formation of the image to be recorded on the recording material (S113).

The image forming portion PM waits by a delay time considering the change performed at the time of calculating the amount of exposure deviation during the image transfer between the image forming portions PY and PM (S114), and then starts formation of the image to be recorded on the recording material and formation of the electrostatic image index synchronous with the image formation (S115).

The positional deviation setting portion 27 waits until the first mark of the electrostatic image index 51M formed actually on the photosensitive drum 1M reaches the transfer position of the image forming portion PM (S116).

When the first mark of the electrostatic image index 51M is detected by a photosensitive drum image positional index detecting portion 20M, the positional deviation detecting portion 26 connects the switch 31 to the upper terminal via the switch signal generating portion 37. Also, the positional deviation setting portion 27 clears the set positional deviation and outputs zero. Accordingly, detection of the phase difference between an actual detection pulse of the electrostatic image index 51M of the photosensitive drum 1M and an actual detection pulse of the electrostatic image index 53 of the intermediate transfer belt 9 is started by the phase comparing portion 28. In other words, drive control of the photosensitive drum 1M is migrated to control of registering the electrostatic image index 51M and the electrostatic image index (S117).

Subsequently, when the image formation to be performed in the print job is completed (S118), rotations of the intermediate transfer belt 9, the photosensitive drums 1Y and 1M, and the rotary polygonal mirrors 43 provided on the exposure units 3Y and 3M are stopped (S119), and the print job is terminated (S120).

<Control Before Transfer—Transfer Control>

As illustrated in FIG. 10, in the control before transfer, when output of the virtual exposure timing signal is started, a state in which a virtual image is formed at an exposure position is achieved synchronously with rising edges of the virtual exposure timing signal. Therefore, assuming that the electrostatic image index 51M is formed on the photosensitive drum 1M, the electrostatic image index synchronous with the rising edges of the virtual exposure timing signal is formed at the exposure position in the same manner as the virtual image as illustrated by a broken line in FIG. 10.

After a period from exposure to transfer is elapsed from a moment when a virtual image which is not exposed at the exposure position on the photosensitive drum 1M is started to be formed, the virtual image reaches the transfer position on the photosensitive drum 1M. After a short time from then, the electrostatic image index of the intermediate transfer belt also reaches the transfer position, and the difference between the two reached times is detected as the positional deviation. Since the positional deviation is calculated by subtracting the reached timing of the electrostatic image index on the intermediate transfer belt from the reached timing of the virtual image, the positional deviation here is a negative value. The photosensitive drum 1M is driven to rotate so as to maintain the positional deviation.

In the control before transfer, the amount of exposure deviation is calculated by inverting the sign of the positional deviation as described above (the amount of exposure deviation is a positive value), and the phase adjustment of the rotary polygonal mirror is performed in a hatched time zone. Here, a case where the positional deviation is less than one line in the sub scanning direction is illustrated. After the phase adjustment of the rotary polygonal mirror, a state in which the electrostatic image index 51M is delayed from the rising edge of the virtual exposure timing signal by an amount of exposure deviation as illustrated by the broken line in FIG. 10. Since the electrostatic image index 51M is synchronous with an image to be formed, the position of the image on the photosensitive drum is in a state of being delayed from the rising edge of the virtual exposure timing signal by the amount of exposure deviation is achieved. In contrast, the virtual image is still in the state of being synchronized with the rising edges of the virtual exposure timing signal.

In the control before transfer, the electrostatic image index and the image are not formed on the photosensitive drum 1M. In this state, assuming that an electrostatic image index and the image are formed on the photosensitive drum 1M, the exposure timing is adjusted so that the electrostatic image index 51M of the photosensitive drum 1M is registered with the electrostatic image index 53 of the intermediate transfer belt 9 at the transfer position.

In this state, image formation for recording an image on a recording material is started. In FIG. 10, the image to be recorded on the recording material is indicated with diagonal lines. The timing at which the electrostatic image index on the intermediate transfer belt reaches the transfer position is maintained in a state of being delayed by an amount corresponding to an absolute value of the positional deviation with respect to the timing at which the virtual image reaches the transfer position. However, the timing at which the electrostatic image index 51M reaches the transfer position through the above-described adjustment is maintained in a state of being delayed by an amount corresponding to the amount of exposure deviation with respect to the timing at which the virtual image reaches the transfer position. Since the absolute value of the positional deviation is equal to the amount of exposure deviation, the electrostatic image index 51M and the electrostatic image index 53 reach the transfer position at the same timing if the image formation is actually performed. In other words, the actual image formation is performed in a state in which the photosensitive drum 1M and the exposure unit 3M are controlled so that the position of the image on the photosensitive drum 1M matches the position of the image on the intermediate transfer belt 9.

<Photosensitive Drum Image Position Estimating Portion>

As illustrated in FIG. 11, the photosensitive drum image position estimating portion 30 estimates the timing at which an image exposed at a certain timing reaches the transfer position of the image forming portion PM.

The photosensitive drum image position estimating portion 30 performs estimation of the position of the image on the photosensitive drum 1M on the basis of rotation angle information detected by reading the encoder scale 55M by the rotation angle detecting portion 52M and the exposure timing information.

The rotation angle information of the photosensitive drum 1M is input from an input terminal 61. The rotation angle information is a pulsed signal switched between High and Low at every rotation of the photosensitive drum 1M by a certain angle. The rotation angle information is input to a rotation angle counter 63.

The rotation angle counter 63 counts up a count value at every rising edge of the input rotation angle information.

The exposure timing information is input from an input terminal 62. The exposure timing information is a pulsed signal in which the timings when the exposure is to be performed are synchronized with the rising edges. For example, when estimating the timing of reaching the transfer position about images at every resolution of 600 dpi in the sub scanning direction at a process speed of 300 mm/sec, a pulse signal having a cycle of the rising edges of approximately 141 μsec is achieved from the following expression, $$(25.4/600)/300 \approx 141\ \mu\text{sec}.$$

When a FIFO writing control portion 64 detects a rising edge of the exposure timing information, the FIFO writing control portion 64 acquires a count value of the rotation angle counter 63 and write the same in a FIFO memory 65. A FIFO reading control portion 66 reads one count value stored in the FIFO memory 65 and outputs the same. Exposure-transfer angle information 67 is added to the count value output from the FIFO reading control portion 66 and is input to a comparing portion 68.

The exposure-transfer angle information descried here is information on an angle of rotation of the photosensitive drum 1M until the image formed by the exposure unit 3Y reaches the transfer position of the image forming portion PM, and is stored in advance in a form of one to one correspondence with the number of pulses of the rotation angle information. For example, in a configuration in which the rotation angle information is output by 360000 pulses while the photosensitive drum 1M rotates 360 degrees, if the rotation angle from the exposure position to the transfer position is 160°, the exposure-transfer angle information is stored as 160000 (pulses) by the following expression, $$360000 \times (160/360) = 160000.$$

A count value of the rotation angle counter 63 is also input to the comparing portion 68, and the comparing portion 68 compares the two inputs and outputs a pulse signal in which the rising edge appears at a timing at which the two inputs become the same to the output terminal 69. The comparing portion 68 compares the two inputs while considering a digit overflow of the rotation angle counter 63 and a digit overflow at the time of adding the exposure-transfer angle information 67.

The comparing portion 68 outputs the fact that the two inputs become equal to the FIFO reading control portion 66. When the fact that the two inputs becomes equal is notified from the comparing portion 68, the FIFO reading control portion 66 reads one new count value from the FIFO memory 65 and outputs the same. By repeating this operation, the photosensitive drum image position estimating portion 30 generates a pulsed signal indicating the timing at which an image exposed at a certain timing reaches the transfer position via the rotation of the photosensitive drum 1M by a predetermined angle. The photosensitive drum image position estimating portion 30 is capable of estimating the position of the image on the photosensitive drum accurately even when the speed of the photosensitive drum varies in this manner.

In the first embodiment, the rotation control of the photosensitive drum is performed so as to maintain the amount of misalignment between the first mark of the electrostatic image index 53 and the first photosensitive drum virtual image positional index. Therefore, an abrupt displacement of the position of the photosensitive drum at the time of starting a position following control may be avoided.

In the first embodiment, the rotational phase of the rotary polygonal mirror is adjusted by an amount calculated from the amount of misalignment, and the exposure unit 3M is controlled so that the position of the image on the intermediate transfer belt and the position of the real image on the photosensitive drum are not misaligned. Therefore, the image formed on the recording material becomes a desirable image without color deviation.

In the first embodiment, in an image forming apparatus in which the color deviation at a short cycle caused by the variations in speed or the like of the conveyed member by the control of the speed of the rotation of the photosensitive drum is reduced, an abrupt positional displacement of the photosensitive drum at the time of start of following control is avoided. Therefore, high-quality image formation is achieved by stabilizing the rotation control of the photosensitive drum while reducing the color deviation at a short cycle, and preventing a regular occurrence of the positional displacement of the photosensitive drum. Also, since the electrostatic image index 51M (51C and 51K) of the photosensitive drum 1M (1C and 1K) is registered with respect to the electrostatic image index 53 of the intermediate transfer belt 9 without causing the speed variations in the photosensitive drum 1M (1C and 1K), not only deterioration of the image quality, but also an occurrence of the vibrations of the image forming apparatus caused by the above-described speed variation may be prevented.

Second Embodiment

Figure 12:
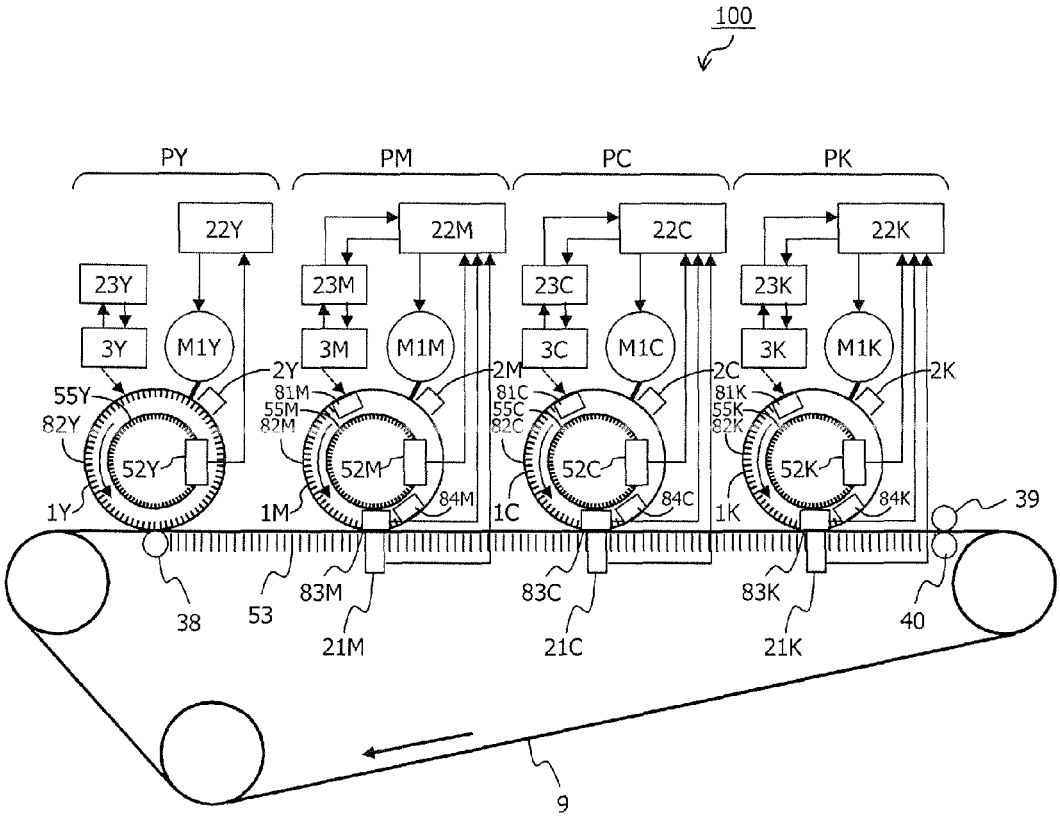
FIG. 12 is an explanatory drawing illustrating a configuration of the image forming apparatus of a second embodiment.
Figure 13:
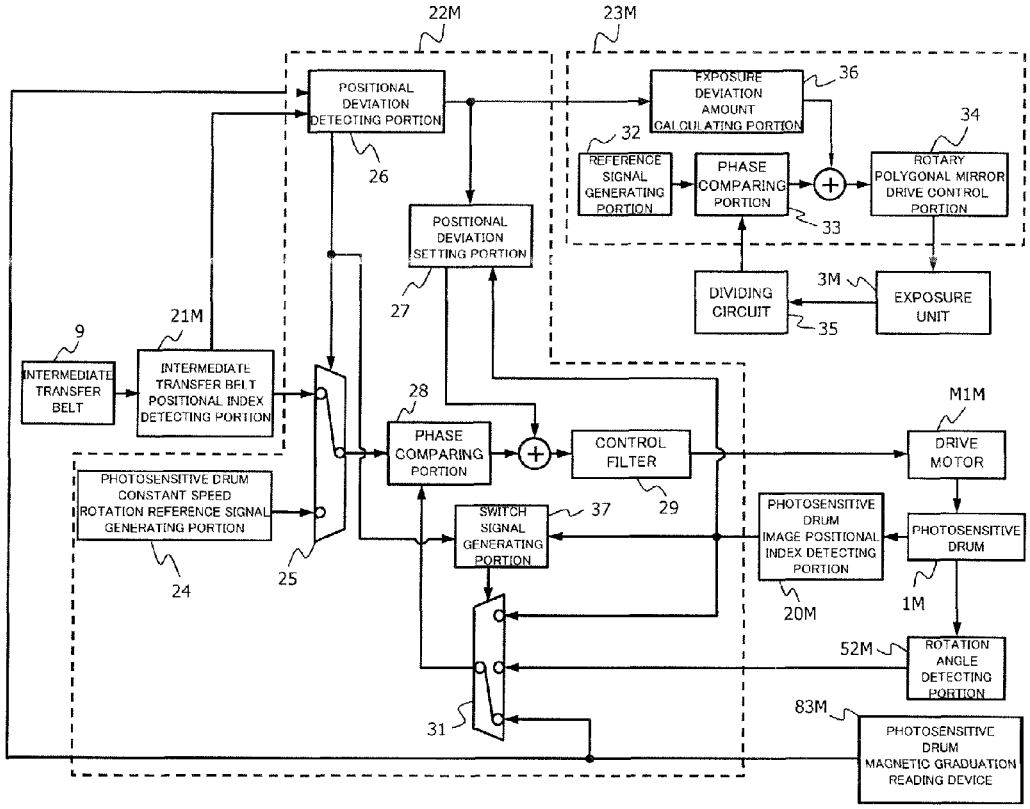
FIG. 13 is a block diagram of a registration control of the second embodiment.

FIG. 12 is an explanatory drawing illustrating a configuration of the image forming apparatus of a second embodiment. FIG. 13 is a block diagram of a registration control of the second embodiment. In the second embodiment, control is performed in the same manner as in the first embodiment except that a magnetic recording index is used instead of the electrostatic image index in the photosensitive drum. Therefore, in FIG. 12 and FIG. 13, in the configurations common to the first embodiment are designated by reference numerals same as those in FIG. 4 and FIG. 8, and duplicated description will be omitted. Portions different from the first embodiment will be described, and description of the same portions as the first embodiment will be omitted. The image forming portion PM will be described and duplicated description relating to the image forming portions PC and PK will be omitted.

As illustrated in FIG. 12, a magnetic recording layer is provided on an inner surface of the photosensitive drum 1M, and a writing device 81M in which a magnetic recording head is used is arranged at a position corresponding to the writing position of the scanning lines by the exposure unit 3M. The writing device 81M magnetically records a magnetic index 82M on the magnetic recording layer synchronously with the virtual exposure timing signal described in the first embodiment.

In the vicinity of the transfer position of the image forming portion PM, a reading device 83M for the magnetic index is arranged. In the transfer control at the time of the image formation, the reading device 83M detects the magnetic index 82M formed synchronously with the image exposure of the exposure unit 3M, and generates pulse signals, which correspond to the respective positions in the direction of rotation of the toner image, on the photosensitive drum 1M. However, in the control before transfer that is executed prior to the image formation, the reading device 83M detects the magnetic index 82M, and generates a pulse signal having a pitch equivalent to the electrostatic image index 53, which corresponds to the respective positions in the direction of rotation of the virtual image, on the photosensitive drum 1M. In the control before transfer, the magnetic index 82M is used as a virtual image positional index on the photosensitive drum 1M to obtain a phase difference between the electrostatic image index 53 and the magnetic index 82M at the transfer position.

As illustrated in FIG. 13, in a third embodiment, the rotations of the intermediate transfer belt 9, the photosensitive drum 1M, and the rotary polygonal mirror of the exposure unit 3M are controlled at a constant speed, and the control is migrated to the control before transfer. In the control before transfer, only the magnetic index 82M is formed on the photosensitive drum 1M.

The positional deviation detecting portion 26 obtains the phase difference between the electrostatic image index 53 and the magnetic index 82M at the transfer position on the photosensitive drum 1M, and outputs the same to the positional deviation setting portion 27 and the exposure deviation amount calculating portion 36.

The positional deviation setting portion 27 and the phase comparing portion 28 control the speed of rotation of the photosensitive drum 1M so that the phase difference between the electrostatic image index 53 and the magnetic index 82M at the transfer position on the photosensitive drum 1M is maintained constant.

The exposure deviation amount calculating portion 36 adjusts the rotational phase between the image data of the exposure unit 3M and the rotary polygonal mirror so that the phase difference between the electrostatic image index 53 and the magnetic index 82M at the transfer position of the photosensitive drum 1M is corrected to zero.

After the adjustment of the exposure unit 3M, the control is migrated to transfer control, where the scanning exposure of the image by the exposure unit 3M and formation of the magnetic index 82M synchronous with the scanning exposure are started. In the transfer control, the speed of rotation of the photosensitive drum 1M is adjusted every second so that the phase difference between the electrostatic image index 53 and the magnetic index 82M at the transfer position on the photosensitive drum 1M becomes zero.

Third Embodiment

In the first embodiment, the electrostatic image index is used as a positional index of the intermediate transfer belt. However, the positional index of the intermediate transfer belt is not limited to the electrostatic image index. The amount of movement of the intermediate transfer belt may be detected by using a linear scale of a fixed pattern using a magnetic pattern or an optical pattern and an encoder.

In a case where the magnetic index is employed as the positional index of the intermediate transfer belt, a magnetic recording layer is provided on the intermediate transfer belt. A magnetic index writing device for the intermediate transfer belt is arranged in the vicinity of the position of transfer of the photosensitive drum 1Y. In a case where the magnetic index is used as a positional index of the photosensitive drum of the photosensitive drum 1Y, a magnetic index reading device for the photosensitive drum is arranged in the vicinity of the transfer position on the photosensitive drum 1Y. In the magnetic index reading device for the photosensitive drum, the magnetic index is written on the intermediate transfer belt 9 by the magnetic index writing device for the intermediate transfer belt every time when the magnetic index of the photosensitive drum 1Y is read.

In contrast, a magnetic index reading device for the intermediate transfer belt is arranged in the vicinity of the transfer position on the photosensitive drum 1M. At the transfer position on the photosensitive drum 1M, registration with respect to the image on the photosensitive drum 1M in the direction of conveyance is performed by using the magnetic index recorded on the intermediate transfer belt 9 as the positional index of the intermediate transfer belt.

It is also possible to use the magnetic index as the positional index of the intermediate transfer belt and perform the control before transfer by using the photosensitive drum image position estimating portion (30: FIG. 8 and FIG. 10) before the formation of the electrostatic image index (51M) in the same manner as in the first embodiment.

It is also possible to use the magnetic index as the positional index of the intermediate transfer belt, and use the magnetic index as the index of the virtual image position of the photosensitive drum as described in the second embodiment.

Also, the magnetic index may be replaced by other fixed pattern such as an optical index. It is also possible to arrange a LED exposure head specific for index writing on at least one of the photosensitive drum and the intermediate transfer belt, and use the electrostatic image index or a toner image obtained by developing the electrostatic image index as the positional index of the image. Alternatively, the magnetic index may be replaced by other physically discriminable alternative writing unit.

In the embodiments described above, "to prepare the first index" includes a case where the first indices in one to one correspondence with the respective positions in the direction of movement of the toner image are additionally formed on the belt member, and a case where the respective positions in the direction of movement of the toner image are additionally brought into one to one correspondence with the first indices provided on the belt member. Also, "to prepare the second index" includes a case where the second indices in one to one correspondence with the respective positions in the direction of rotation of the toner image are additionally formed on the image carrier, and a case where the respective positions in the direction of rotation of the toner image are additionally brought into one to one correspondence with the second indices provided on the image carrier. Furthermore, "to control the image carrier" includes a case where the position of the image carrier in the direction of movement of the belt member as described in JP-A-2009-134264 is adjusted.

Therefore, when a fixed linear scale is employed, estimation of the position of the image as performed in the image forming portion PM of the first embodiment is performed for the fixed linear scale on the intermediate transfer belt in the image forming portion PY. Then, on the basis of the result of estimation, the phase adjustment of the exposure unit 3M is performed by using the photosensitive drum image position estimating portion. Subsequently, the position of the scale of the linear encoder is specified by using the timing at which reaching the estimated transfer position TY, and the position of the scale of the linear encoder specified at the transfer position TM of the image forming portion PM is detected to use as the positional index of the intermediate transfer belt. In this manner, the position of the image on the intermediate transfer belt estimated by the same method as the photosensitive drum image position estimating portion described in the first embodiment may be used as the positional index of the intermediate transfer belt.

Also, the estimation of the position of the image described in the first embodiment may be realized by replacing the rotation angle information of the photosensitive drum 1M with surface position information. A scale of regular pitch may be provided on the surface of the photosensitive drum 1M and a detecting portion configured to detect the scale and output a pulse signal as the surface position information is provided on the photosensitive drum 1M. The surface position information of the photosensitive drum 1M obtained from the detecting portion is used instead of the rotation angle information and the same process as a case where the rotation angle information is used is performed to estimate the position of the image on the photosensitive drum.

Furthermore, in the first embodiment, control is migrated to the registration control between the electrostatic image index 51M and the electrostatic image index 53 after the image to be formed on the recording material has reached the transfer position. However, this disclosure is not limited thereto. For example, the drive control portion 22M may control the speed of rotation of the photosensitive drum 1M every second so as to maintain a predetermined phase difference between the pulse signal that the position detecting portion 20M outputs upon detection of the electrostatic image index 51M and a pulse signal output by the rotation angle detecting portion 52M after formation of the toner image has started.

Alternatively, the exposure control portion 23M may control the exposure unit 3M of the image forming portion PM so that the respective positions of the toner image at the transfer position TM is registered to the corresponding marks of the electrostatic image index 51M in a state in which the drive control portion 22M maintains the phase difference between the above-described pulse signals before starting the formation of the toner image.

Specifically, such control that the processes in S116 and S117 in FIG. 9 are omitted, and instead, control of maintaining the phase relationships between the electrostatic image index 53 and the positional index of the virtual image on the photosensitive drum also at the time of forming an image on the recording material may be continued. In this case, provision of the potential sensor (20M) configured to detect the electrostatic image index area of the photosensitive drum 1M and the electrostatic image index of the photosensitive drum 1M is no longer necessary, and an image forming apparatus in which the number of components is reduced is realized.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-029570, filed Feb. 19, 2013, which is hereby incorporated by reference herein in its entirety.

What is claimed is:

1. An image forming apparatus comprising:

an image carrier;

a toner image forming portion configured to form a toner image on the image carrier;

a belt member on which the toner image carried on the image carrier is transferred at a transfer position;

a first index preparing portion configured to prepare a first index on the belt member before the toner image carried on the image carrier is transferred, the first index corresponding to a position on the belt member in a direction of movement of the belt member of the toner image to be transferred from the image carrier;

a second index preparing portion configured to prepare a second index on the image carrier, the second index corresponding to a position on the image carrier in a direction of rotation of the image carrier of the toner image;

a first index detecting portion configured to detect the first index;

a second index detecting portion configured to detect the second index; and a control portion configured to control the toner image forming portion such that a position on the image carrier where the second index is to be formed is registered to the first index at the transfer position before starting formation of the second index by the second index preparing portion and to control a drive of the image carrier such that the second index is registered to the first index at the transfer position, after the formation of the second index by the second index preparing portion has started, on a basis of results of the detection of the first index detecting portion and the second index detecting portion.

2. The image forming apparatus according to claim 1, wherein the second index preparing portion forms the second index on the image carrier synchronously with the formation of the toner image on the image carrier, and the control portion adjusts timing at which the second index is formed by the second index preparing portion while controlling the speed of rotation of the image carrier in accordance at least with the result of detection of the first index detecting portion.

3. The image forming apparatus according to claim 2, further comprising a rotation angle detecting portion configured to detect a third index to be rotated integrally with the image carrier and to generate a pulse signal that specifies time at which the position on the image carrier on which the second index is to be formed reaches the transfer position, wherein the control portion controls the speed of rotation of the image carrier so as to maintain a phase misalignment between a pulse signal that the first index detecting portion outputs upon detection of the first index and the pulse signal that the rotation angle detecting portion outputs constant.

4. The image forming apparatus according to claim 3, wherein the control portion adjusts the timing of formation of the second index by the second index preparing portion corresponding to the phase misalignment between the pulse signal that the first index detecting portion outputs upon detection of the first index and the pulse signal that the rotation angle detecting portion outputs.

5. The image forming apparatus according to claim 4, wherein the toner image forming portion includes an exposure unit configured to form an electrostatic image to be developed as the toner image on the image carrier, and the second index preparing portion is the exposure unit configured to form the second index of an electrostatic image on the image carrier in association with formation of the electrostatic image of the toner image.

6. The image forming apparatus according to claim 5, further comprising:

an upstream image carrier on which another toner image is formed;

an upstream exposure unit configured to form an index of an electrostatic image on the upstream image carrier in association with formation of the electrostatic image of the other toner image; and an electrostatic image transfer portion configured to transfer the index of the electrostatic image formed on the upstream image carrier to the belt member to form the first index in association with transfer of the other toner image.

7. The image forming apparatus according to claim 2, wherein the toner image forming portion includes an exposure unit configured to form an electrostatic image to be developed as the toner image on the image carrier, and the second index preparing portion is the exposure unit configured to form the second index of an electrostatic image on the image carrier in association with formation of the electrostatic image of the toner image.

8. The image forming apparatus according to claim 7, wherein the first index preparing portion forms the first index on the belt member synchronously with transfer of another toner image on the belt member before the toner image carried on the image carrier is transferred.

9. The image forming apparatus according to claim 5, wherein the first index preparing portion forms the first index on the belt member synchronously with transfer of another toner image on the belt member before the toner image carried on the image carrier is transferred.

10. The image forming apparatus according to claim 9, further comprising:

an upstream image carrier on which the other toner image is formed;

an upstream exposure unit configured to form an index by an electrostatic image on the upstream image carrier in association with formation of the electrostatic image of the other toner image; and an electrostatic image transfer portion configured to form the first index by transferring the index of the electrostatic image formed on the upstream image carrier to the belt member in association with transfer of the other toner image.

11. An image forming apparatus comprising:

an image carrier;

a toner image forming portion configured to form a toner image on the image carrier;

a belt member on which the toner image carried by the image carrier is transferred at a transfer position;

a first index preparing portion configured to prepare a first index on the belt member before the toner image carried on the image carrier is transferred, the first index corresponding to a position in a direction of movement of the belt member of the toner image to be transferred from the image carrier on the belt member;

a first index detecting portion configured to detect the first index;

a third index detecting portion configured to detect a third index to be rotated integrally with the image carrier;

a pulse generating portion configured to generate a pulse signal that specifies time at which a position in a direction of rotation of the image carrier of the toner image on the image carrier reaches the transfer position by processing an output signal from the third index detecting portion; and a control portion configured to control the toner image forming portion such that the position of the toner image on the image carrier is registered with the first index at the transfer position in a state in which a pulse signal that the first index detecting portion outputs upon detection of the first index has a predetermined phase difference from the pulse signal that the pulse generating portion outputs before starting the formation of the toner image by the toner image forming portion and to control a speed of rotation of the image carrier such that the pulse signal that the first index detecting portion outputs upon detection of the first index has the predetermined phase difference from the pulse signal that the pulse generating portion outputs after starting the formation of the toner image by the toner image forming portion.

* * * * *